US005855823A

United States Patent [19]

MacGibbon et al.

[11] Patent Number: 5,855,823

[45] Date of Patent: Jan. 5, 1999

[54] STEAM HUMIDIFIER

[75] Inventors: Bruce S. MacGibbon, Oswego; Christopher P. Sirovy, Tigard; Mark C. Wolochuk; Travis J. Addington, both of Portland, all of Oreg.; Chuck K. McCabe, Mission Viejo, Calif.; Greg A. Marvell, Lake Oswego, Oreg.

[73] Assignee: Huntair Inc., Tigard, Oreg.

[21] Appl. No.: 857,868

[22] Filed: May 16, 1997

[51] Int. Cl.[6] ..... B01F 3/04; F24F 6/10

[52] U.S. Cl. ..... 261/142; 261/70; 261/DIG. 15; 261/DIG. 29; 239/136; 392/405

[58] Field of Search ..... 261/131, 142, 261/70, DIG. 4, DIG. 15, DIG. 29; 237/78 R; 239/136; 392/405

[56] References Cited

U.S. PATENT DOCUMENTS

| | | | |
|---|---|---|---|
| Re. 33,414 | 10/1990 | Morton | 392/386 |
| Re. 34,739 | 9/1994 | Nelson et al. | 126/113 |
| 1,625,663 | 4/1927 | Kelly | 261/142 |
| 1,635,636 | 7/1927 | Rayman | 261/142 |
| 2,092,810 | 9/1937 | McLean | 261/142 |
| 2,976,026 | 3/1961 | Aguirre | 261/142 |
| 3,035,145 | 5/1962 | Rudolph | 261/142 |
| 3,982,095 | 9/1976 | Robinson | 261/142 |
| 4,239,956 | 12/1980 | Morton | 219/272 |
| 4,288,396 | 9/1981 | Ottestad | 261/142 |
| 4,336,783 | 6/1982 | Henson | 261/142 |
| 4,618,462 | 10/1986 | Fisher | 261/142 |
| 4,753,758 | 6/1988 | Miller | 261/142 |
| 5,000,765 | 3/1991 | Nelson . | |
| 5,199,486 | 4/1993 | Balmer et al. | 165/47 |
| 5,372,753 | 12/1994 | Morton | 261/118 |

FOREIGN PATENT DOCUMENTS

| | | | |
|---|---|---|---|
| 2-306034 | 12/1990 | Japan | 261/142 |
| 5-52372 | 3/1993 | Japan | 261/142 |

OTHER PUBLICATIONS

Dri–Steem Humidifer Co., Product Catalog, p. 19: Vaporstream® Model "D.I." (1991).

Dri–Steem Humidifer Co., Installation Instructions and Maintenance Operations Manual: Vaporstream® and Vaporstream®DI (1993).

*Primary Examiner*—C. Scott Bushey

*Attorney, Agent, or Firm*—Miller, Nash, Wiener, Hager & Carlsen LLP

[57] ABSTRACT

The present invention is a humidifier that provides uniformly controlled generation of water vapor into an air stream. Steel wool is placed into a heating section of a humidifier water reservoir, where vapor is produced, to create an even distribution of vapor exiting the humidifier. A perforated plate is horizontally inserted into the heating section above the steel wool, thereby holding it in place and aiding in the even distribution of vapor from the humidifier.

7 Claims, 3 Drawing Sheets

STEAM HUMIDIFIER

FIELD OF THE INVENTION

The present invention relates generally to humidifiers of the type used in heating, ventilation, and air-conditioning systems in buildings. More particularly, the invention relates to a humidifier that provides an improvement in the generation and dispersion of water vapor into an ambient air stream.

BACKGROUND INFORMATION

In semiconductor chip fabrication operations, it is crucial that temperature, air pressure, and humidity conditions be maintained precisely. A slight variation in any of these environmental factors can have detrimental effects on the fabrication process.

Dry air is particularly troublesome. Not only is a precise humidity level required for the fabrication process, but also, dry air has other adverse effects, such as drawing moisture out of materials and contributing to the generation of static electricity. These potential problems make controlling the level of humidity extremely important.

Many chip fabrication and clean room operations are equipped with steam humidifiers installed in the air supply or ventilation systems. However, there are a number of problems and disadvantages with these humidifying systems. One common problem is that they humidify the ambient air unevenly. That is, some humidifiers produce a non-uniform absorption and mixing of water vapor into the ambient air stream. If too much vapor is introduced by the humidifier, the excess amount is not absorbed by the air stream. The excess amount condenses on virtually any surface it contacts. Obviously, this is an unacceptable problem in semiconductor manufacturing operations, where a pristine environment is required.

The most relevant prior art that relates to the above problem is the Vaporstream® Model "D.I." humidifier manufactured by Dri-Steem Humidifier Company. This humidifier features an external, stainless steel, vapor dispersion tube with a plurality of holes, arranged so that multiple jets of steam or vapor coming out of the holes are introduced into the ambient air stream. By introducing multiple jets of steam into the air stream in this manner, the Dri-Steem humidifier claims to produce an improvement in the rate and thoroughness of vapor absorption. Dri-Steem's tube design also allows any condensate which forms on the interior of the tube to flow back to the humidifier.

The present invention is a humidifier that differs significantly from the prior art in that it utilizes structures placed within the humidifier's water reservoir to uniformly control the generation of steam, as opposed to using a multiple-holed dispersion tube located outside of the humidifier reservoir. How the invention works is further described below.

SUMMARY OF THE INVENTION

The invention is an improved humidifier having a water reservoir that is divided into two sections by a wall. The divider wall keeps the water inflow from affecting the boiling process.

One section has a means for controlling the water level in the humidifier. This is disclosed below as a water-metering float. The water-metering float controls the refilling of the humidifier as the water level inside the humidifier lowers due to evaporation. As with similar floats used in toilet tanks, the water metering float would lower as the water level lowers, and then rise as the humidifier is refilled. The float stops the refilling when an operating water level is reached. The low water float switch similarly activates an emergency switching signal when the water falls to a very low level. The switching signal would disable the humidifier until the low water problem is corrected. While this arrangement is preferred in the context of the best embodiment of the invention, as it is presently known, it is to be understood that other kinds of structures could function equivalently.

The divider wall has openings in its lower section which permit water to pass from the inflow section of the humidifier to the heating section. Consequently, regardless of the height of the water in the humidifier, the level will always be the same in both sections.

Positioned in a lower region of the heating section is a heating element. The heating element is in the form of an elongated cal rod. These types of elements are well-known in the art.

In order to ensure that the humidifier will generate a uniform vapor output, positioned in the heating section is a means for uniformly controlling the generation of water vapor. The heating element creates vapor by increasing water temperature to a point where boiling takes place. Localized heating is not necessarily uniform along the length of the heating element or across the length and width of the heating section. This can create non-uniform vapor rising from the heating section. In order to significantly reduce or entirely eliminate this problem, the means for uniformly controlling the generation of water vapor evens out the vapor outflow as it is created, so that it will remain uniformly consistent as it exits the humidifier. It also enables more precise control of humidifier vapor output.

In the preferred embodiment of the invention, the means for controlling the generation of water vapor is in the form of stainless steel wool which completely fills the heating section of the humidifier. The heating element is embedded in and in contact with the steel wool. This enables heat to be conducted from the heating element into the strands of the steel wool, thereby improving uniformity in heat transfer from the heating element to the water in the heating section of the humidifier. The net effect is that vapor generation becomes less localized at the specific location of the heating element, but instead becomes spread throughout a reservoir of water consistent with the matrix of material defined by the steel wool.

A horizontal plate positioned in and across the heating section serves to hold the steel wool in place and to further assist in the even dispersion of vapor as it is generated by the humidifier. The plate has a plurality of openings distributed evenly across its surface which enhances even water vapor generation.

Further details of the invention are set forth below. The above summary of the invention is not intended to limit the scope of the invention. Any terms used in this document are to be interpreted in accordance with their plain and ordinary meaning as defined in any acceptable dictionary of the English language, unless expressly indicated otherwise.

BRIEF DESCRIPTION OF THE DRAWINGS

In the drawings, like numerals refer to like parts throughout the various views, unless otherwise specified, and wherein.

BEST MODE FOR CARRYING OUT THE INVENTION

Figure 1A:
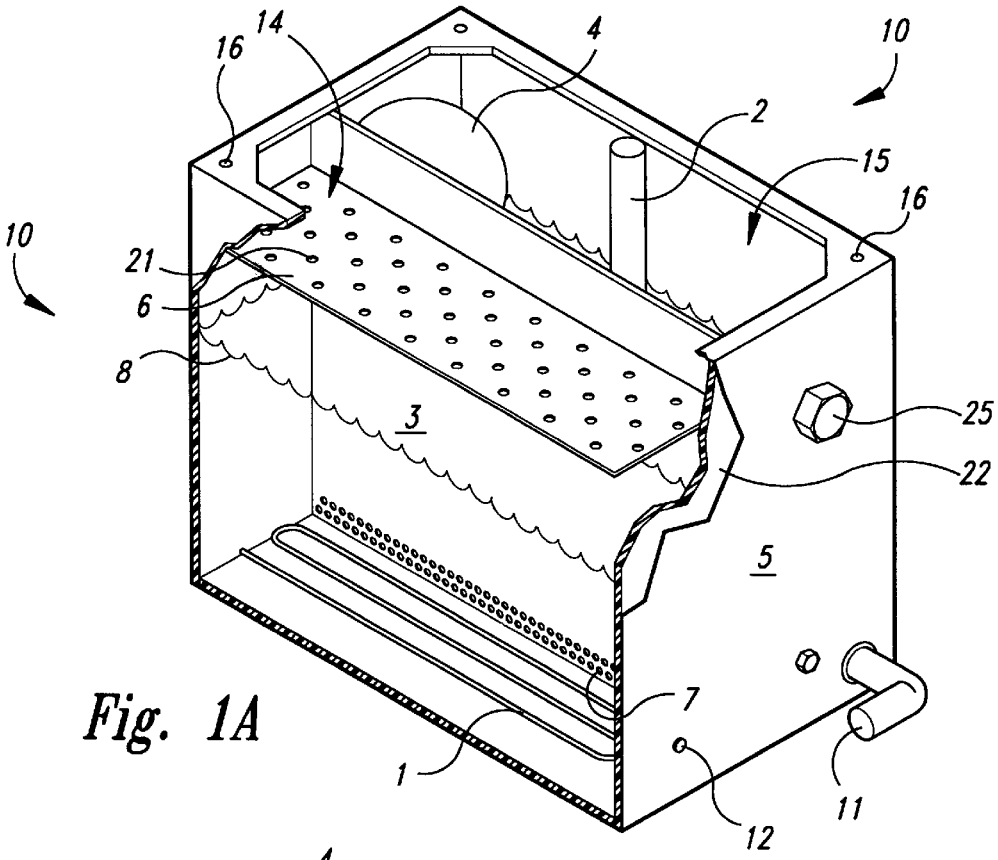
FIG. 1A is a front perspective view of the invention, where the steel wool, a side panel, and top cover of the humidifier have been removed so as to show interior structure.
Figure 1B:
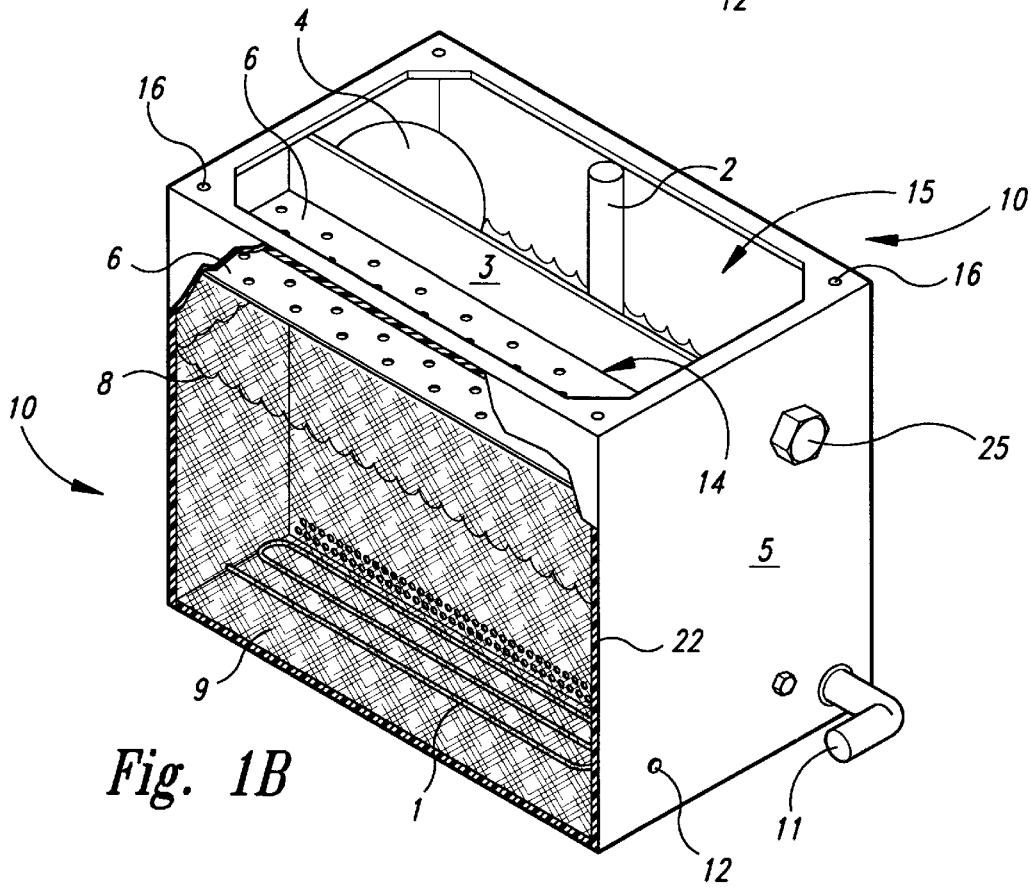
FIG. 1B is a view similar to FIG. 1A, but shows the steel wool in the heating section.

Referring first to FIG. 1A, shown generally at 10 is the improved humidifier (shown without the steel wool 9). In this view and in FIG. 1B, the front side of the humidifier 10 has been cut away for clarity. The exterior shell of the humidifier 10, such as at side 5, is typically constructed out of a sheet of stainless steel or some other corrosion-resistant or rust-resistant material. Normally, a layer of insulation is positioned on the outside of the shell. This is not shown in the drawings, however, as insulating the shell is conventional and is not germane to what is considered to be the invention here. What is important is that all sides of the humidifier 10 should be insulated, and the type of insulation should be of a type suitable for humidifiers. The top cover 17 of the humidifier 10 (shown in FIGS. 4 and 5) is attached by bolts or suitable pegs 23 which fit into corner holes 16.

The humidifier 10 is separated into two reservoir sections 14 and 15, respectively, by a vertical divider wall 3. A series of small-diameter holes 7 are drilled through the base of the wall 3 to allow water to pass from one reservoir section 15 to the other 14.

Figure 2:
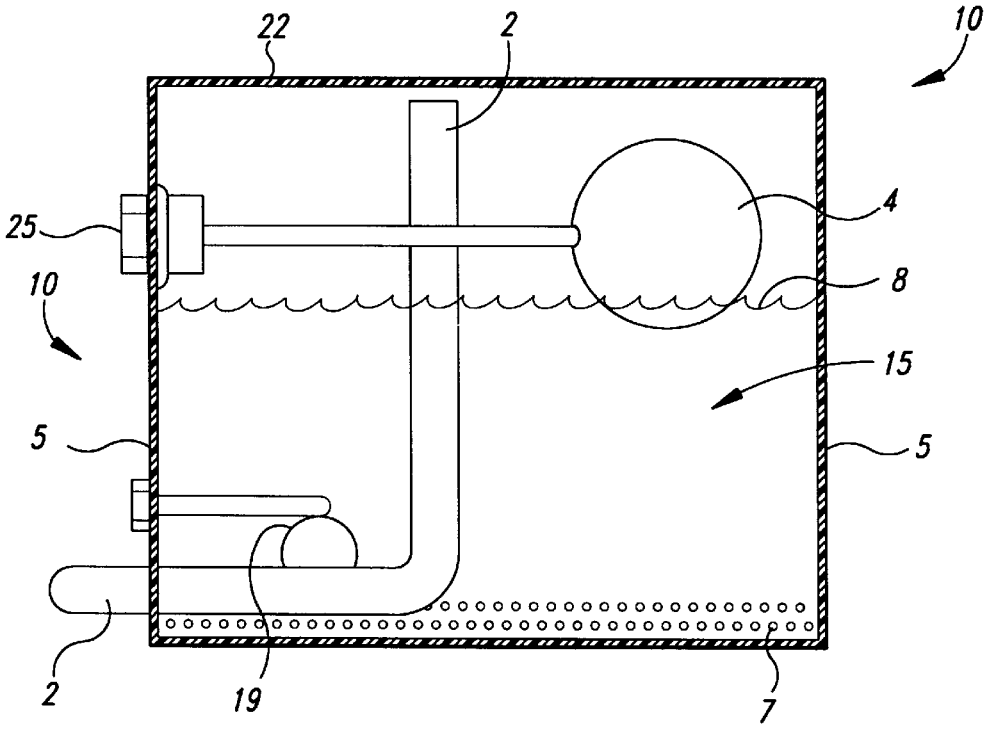
FIG. 2 is a side view of the invention, but is sectioned through the invention just on the aft side of a divider wall that halves the interior structure.

Referring now to both FIGS. 1A and 2, shown at 4 is a water-metering float located in section 15 for controlling the water level 8. The float 4 is a buoyant, hollow ball and moves up or down with the water level 8, regulating the speed at which water flows into the humidifier. The float 4 will entirely stop water flow into section 15 when the operating water level 8 has been attained. This is similar to the operation of toilet floats and is well understood. A valve attached at fitting 25 controls the refilling process depending on the level of the float 4. When the water level lowers, because of evaporation from the humidifier 10, the float 4 will move down, causing the valve 25 to refill section 15 with water. The float 4 will then rise until the operating water level 8 is reached. The actual water inlet can be positioned in any number of different places through the exterior wall 5 of the humidifier 10, so long as water inflow occurs in section 15. Fitting 25 shows a suitable inlet location, for example.

The float 4 controls the water level only. A low water float or float switch 19 is positioned within reservoir section 15. This float switch 19 activates when the water level 8 in the humidifier has fallen dangerously low, signifying that the water supply to the humidifier has been cut off or that the humidifier is not refilling properly. In such a situation, the float switch 19 will send a signal to the system controller to disable the humidifier.

Figure 4:
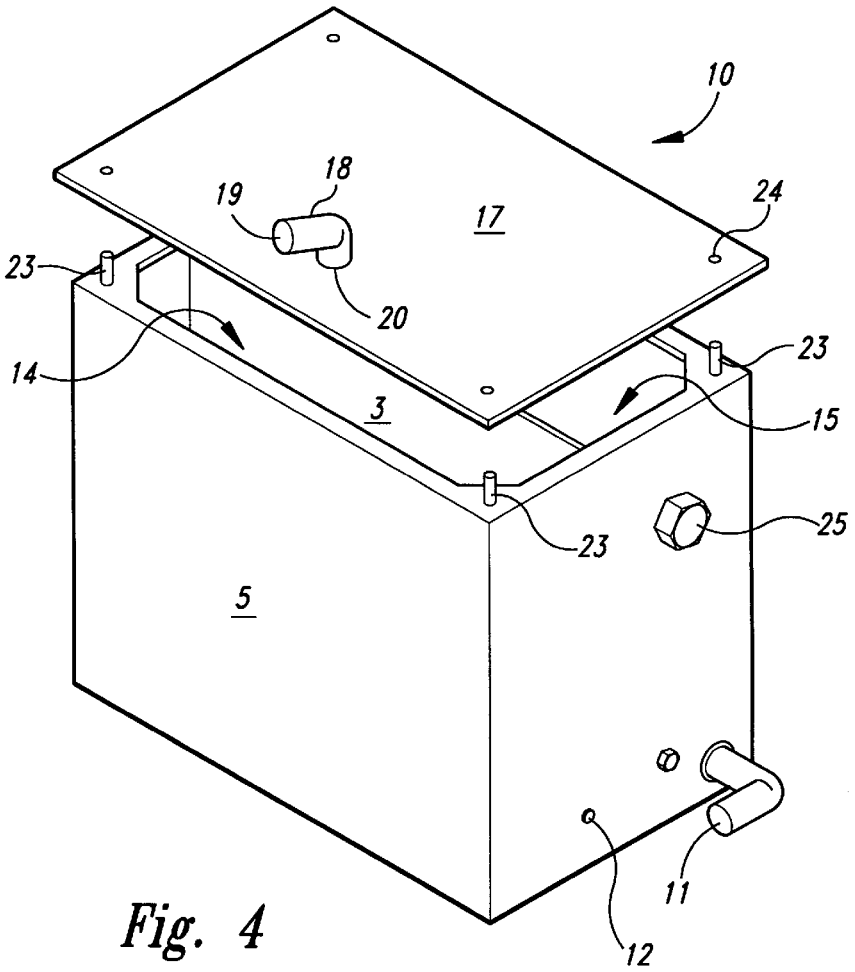
FIG. 4 is a front perspective view of the invention, along with the top cover.

Reservoir section 15 also features a stand-pipe 2. The function of the stand-pipe 2 is to prevent an accidental overflow of water supplied into section 15. If, through a malfunction of the float and valves just described, the water level 8 in section 15 gets higher than the top rim of stand-pipe 2, then the excess water will flow into the top opening of the stand-pipe and drain out through the opposite end 11. The end 11 protrudes out of panel side 5 of the humidifier 10 as shown in FIGS. 1 and 4.

Figure 3:
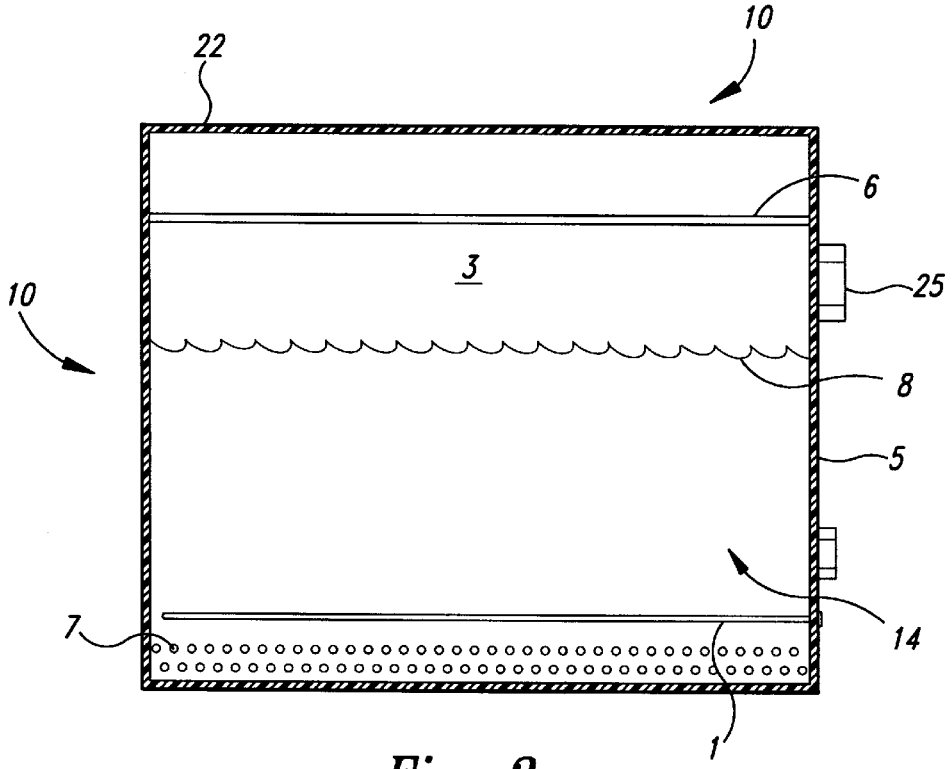
FIG. 3 is a view similar to FIG. 2, but is sectioned on the forward side of the divider wall.

Referring now to both FIGS. 1A and 3, reservoir section 14 is a "heating section" that houses a heating element or rod 1 and is filled with stainless steel wool, which is indicated at 9. The heating rod 1 is positioned in a lower portion of section 14 so that it will normally be below the lowest point of the water level in section 14. In most respects, the heating rod 1 is the same as conventional cal rods used in electric water heaters, and can be obtained from any number of sources. Its power source is made through conventional electrical connections at 12 on panel side 5.

In FIG. 1A, a perforated plate 6 is placed horizontally across the reservoir or heating section 14 at a height that is above the highest water level 8. Plate 6 has a series of small-diameter holes 21 drilled and spaced evenly throughout its surface. The plate 6 essentially functions to hold down the stainless steel wool 9 which, as mentioned above, completely fills the heating section 14.

As mentioned above in the summary of the invention, the steel wool 9 provides a means for generating water vapor used in combination with the heating element 1. The heating element is embedded in the steel wool 9 which means that strands of the steel wool directly contact the outer surface of the heating element. This results in heat conduction throughout the matrix of the steel wool. The net effect is that heat is conducted more uniformly throughout the water in the heating section and, to the extent localized boiling is generated in the vicinity of the heating element or elsewhere, the vapor bubbles are dispersed by the steel wool before the vapor exits the humidifier. Preferably, the operating water level 8 will never be higher than the highest point of the steel wool 9.

Figure 5:
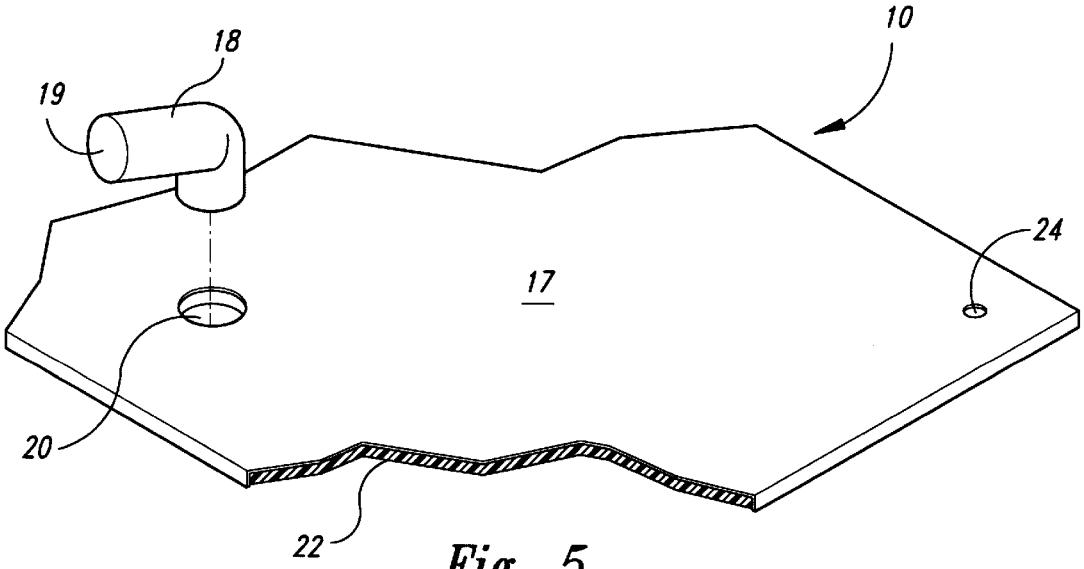
FIG. 5 is an enlarged sectional view of a portion of the top cover of the invention.

Referring now to both FIGS. 4 and 5, FIG. 4 shows the humidifier 10 along with its top cover 17. The top cover 17 is attached to the humidifier 10 by a set of four bolts or pegs 23 running through the corner holes 16 of the humidifier 10 and the corner holes 24 of the top cover 17. The top cover 17 is removable during maintenance operations simply by lifting it off the pegs 23. A steam tube 18 is connected to the top cover 17 at 20, such that opening 20 defines a steam exit hole above the center of reservoir section 14. The exit end 19 of steam tube 18 is then connected to any conventional dispersion tube or other duct work. FIG. 5 shows more of the details of top cover 17.

Again, referring to FIGS. 1A and 1B, an important aspect of the invention lies in the use of the stainless steel wool 9. The inventor has discovered that adding the steel wool 9 drastically improves the dispersion of steam created by the heating rod 1.

The foregoing description sets forth the best mode for carrying out the invention. It is to be appreciated that there may be many ways of modifying the invention without departing from the spirit and scope of the invention as described above. For example, alternative materials may be discovered that provide the same function as steel wool. The heating element described above could take many different kind of forms and still perform the same function. The specific types of floats and switches can be altered in various ways and still do the same thing. Consequently, the above description is not to be read as limiting the invention. Instead, the invention is to be limited solely by the claim or claims which follow, the interpretation of which are to be made in accordance with the standard doctrines of patent claim interpretation.

What is claimed is:

1. A humidifier for use in connection with clean room operations comprising:

a reservoir divided into two sections by a divider wall, the divider wall having openings for enabling water to pass from one section to the other;

a heating element located in one section;

a means for uniformly controlling the generation of water vapor, wherein the means is positioned in the same section as the heating element, such that the means directly contacts the heating element and is immersed in the water;

and a vapor outlet positioned above the same section.

2. The humidifier of claim 1, wherein the means for uniformly controlling the generation of water vapor is a steel wool material.

3. The humidifier of claim 2, including a horizontal plate positioned in the section in which the heating element is located, the plate having a plurality of openings distributed evenly across its surface.

4. The humidifier of claim 1, including means for controlling the water level in the humidifier positioned in the other humidifier section relative to the section in which the heating element is located.

5. The humidifier of claim 4, wherein the means for controlling the water level in the humidifier includes a water-metering float for keeping the water in the humidifier filled at a certain operating level, and a low water float for activating a switching signal to shut down the humidifier when the water falls to a low level.

6. A humidifier for use in connection with clean room operations comprising:

a reservoir divided into two sections by a divider wall, the divider wall having openings for enabling water to pass from one section to the other;

a heating element located in one section;

a steel wool material having a plurality of strands for uniformly controlling the generation of water vapor, wherein the steel wool is positioned in the same section as the heating element, such that some of the strands substantially surround and directly contact the heating element, and further, at least a portion of the steel wool is immersed in the water;

and a vapor outlet positioned above the same section.

7. The humidifier of claim 6, including a horizontal plate positioned above the steel wool and in the section in which the heating element is located, the plate having a plurality of openings distributed evenly across its surface.

* * * * *